US006019071A

United States Patent [19]

Maciejka, Jr.

[11] Patent Number: 6,019,071

[45] Date of Patent: Feb. 1, 2000

[54] ENGINE WINDAGE TRAY

[75] Inventor: William Maciejka, Jr., Troy, Mich.

[73] Assignee: Chrysler Corporation, Auburn Hills, Mich.

[21] Appl. No.: 09/158,305

[22] Filed: Sep. 22, 1998

[51] Int. Cl.[7] ..... F01P 3/08; F02F 7/00

[52] U.S. Cl. ..... 123/41.35; 184/6.5; 123/195 H

[58] Field of Search ..... 123/41.35, 195 C, 123/195 H, 196 R; 184/6.5

[56] References Cited

U.S. PATENT DOCUMENTS

| | | | |
|---|---|---|---|
| 2,234,455 | 3/1941 | Smith | 123/73 R |
| 3,065,743 | 11/1962 | Brehm et al. | 123/41.08 |
| 3,688,871 | 9/1972 | Krestan et al. | 184/6.5 |
| 3,888,227 | 6/1975 | Green et al. | 123/196 R |
| 3,888,228 | 6/1975 | Koivunen | 123/196 R |
| 4,010,718 | 3/1977 | Stewart | 123/41.35 |
| 4,270,497 | 6/1981 | Valerio | 123/195 C |
| 4,519,348 | 5/1985 | Hamilton | 123/195 C |
| 5,038,890 | 8/1991 | Tanaka et al. | 184/6.5 |
| 5,058,545 | 10/1991 | Hirai et al. | 123/195 C |
| 5,092,291 | 3/1992 | Langlois | 123/196 R |
| 5,103,782 | 4/1992 | Matsui | 123/195 C |
| 5,158,053 | 10/1992 | Krechberger et al. | 123/195 C |
| 5,161,643 | 11/1992 | Ampferer | 184/6.5 |
| 5,456,227 | 10/1995 | Shimmell et al. | 123/195 H |
| 5,465,692 | 11/1995 | Uraki et al. | 123/195 C |
| 5,533,472 | 7/1996 | Sands et al. | 123/41.35 |
| 5,653,205 | 8/1997 | Ozeki | 123/195 C |

*Primary Examiner*—Tony M. Argenbright
*Assistant Examiner*—Arnold Castro
*Attorney, Agent, or Firm*—Kenneth H. Maclean

[57] ABSTRACT

An internal combustion engine for a vehicle includes a crankshaft, a piston movable through a cycle, a piston rod connecting the piston and the crankshaft, an oil pan spaced from the crankshaft, and an oil source providing pressurized oil. An inventive windage tray is positioned between the crankshaft and the oil pan. The windage tray includes a passage having an inlet port receiving the pressurized oil and a first outlet port directing a first stream of the pressurized oil at the piston. In a preferred embodiment of the present invention, the passage further includes a second outlet port directing a second stream of pressurized oil at the piston. The first outlet port is positioned to direct the first stream of pressurized oil upon the piston unobstructed by the piston rod during a first portion of the piston cycle. The second outlet port is positioned to direct the second stream of pressurized oil upon the piston unobstructed by the piston rod during the remaining portion of the piston cycle.

11 Claims, 3 Drawing Sheets

ENGINE WINDAGE TRAY

FIELD OF THE INVENTION

The subject invention relates to a windage tray for an engine.

BACKGROUND OF THE INVENTION

Many vehicle engines are built with either a standard output performance package or a high output performance package. Based upon a typical market demand, only a small percentage of the total engine production is built with the high output performance package. Often there are design differences between the standard performance package and the high performance package which complicate the assembly line production of the engine. One particular design difference is that the high performance package typically requires additional cooling for each engine piston. As a result, oil squirters have been installed in high output performance engines.

FIG. 1 is a perspective view of a prior art oil squirter 10 installed in a high output performance engine 12 with portions of the engine broken away to show a piston 14 in a cylinder bore 16. The oil squirter 10 is mounted to an engine block 18 spaced from the piston 14. The oil squirter 10 is designed to cool the piston 14 by directing a stream of engine oil 20 at the underside of the piston 14 when the engine 12 is running. Typically, each piston in a high output performance engine requires an oil squirter.

Although the oil squirter 10 provides the required additional piston cooling, it has several shortcomings. Foremost, to supply the oil squirter 10 with pressurized oil, an oil supply hole is drilled and tapped into an engine block oil gallery 22 during assembly of the engine 12. However, engines built with the standard output performance package do not include oil squirters and, therefore, do not utilize the oil supply holes. Capping or plugging each oil supply hole during the assembly of each high volume standard output performance engine is expensive and time consuming. Accordingly, it would be desirable to provide a windage tray, having an inventive oil squirting feature, to be installed in engines built with the high output performance package, thus eliminating the need for oil squirters.

SUMMARY OF THE INVENTION

An internal combustion engine for a vehicle includes a crankshaft, a piston movable through a cycle, a piston rod connecting the piston and the crankshaft, an oil pan spaced from the crankshaft, and an oil source providing pressurized oil. An inventive windage tray is positioned between the crankshaft and the oil pan. The windage tray includes a passage having an inlet port receiving the pressurized oil and a first outlet port directing a first stream of the pressurized oil at the piston.

In a preferred embodiment of the present invention, the passage further includes a second outlet port directing a second stream of pressurized oil at the piston. The first outlet port is positioned to direct the first stream of pressurized oil upon the piston unobstructed by the piston rod during a first portion of the piston cycle. The second outlet port is positioned to direct the second stream of pressurized oil upon the piston unobstructed by the piston rod during the remaining portion of the piston cycle.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
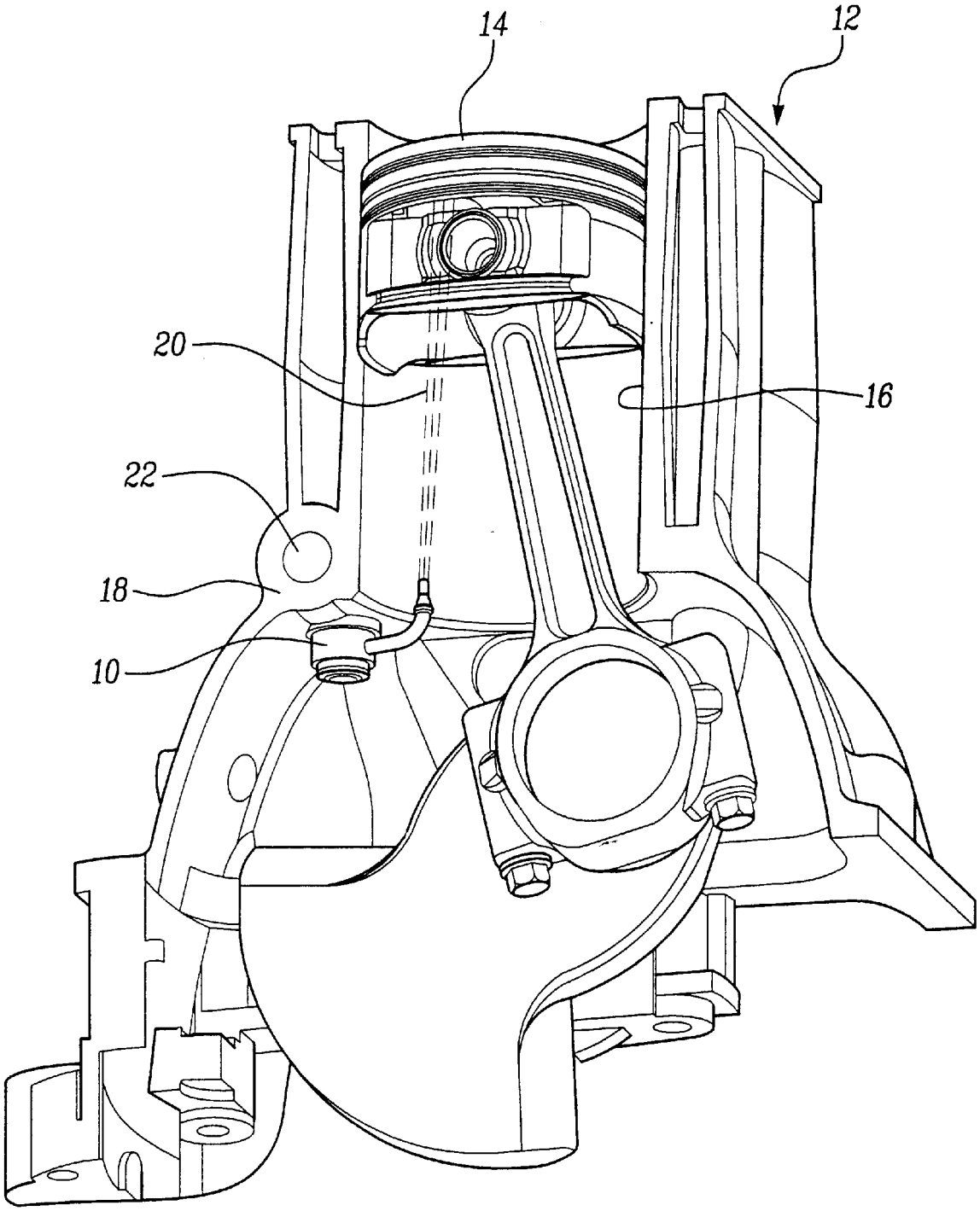
Fig-1 PRIOR ART
FIG. 1 is a perspective view of a prior art oil squirter installed in a high output performance engine with portions of the engine broken away to show a piston in a cylinder bore.
Figure 2:
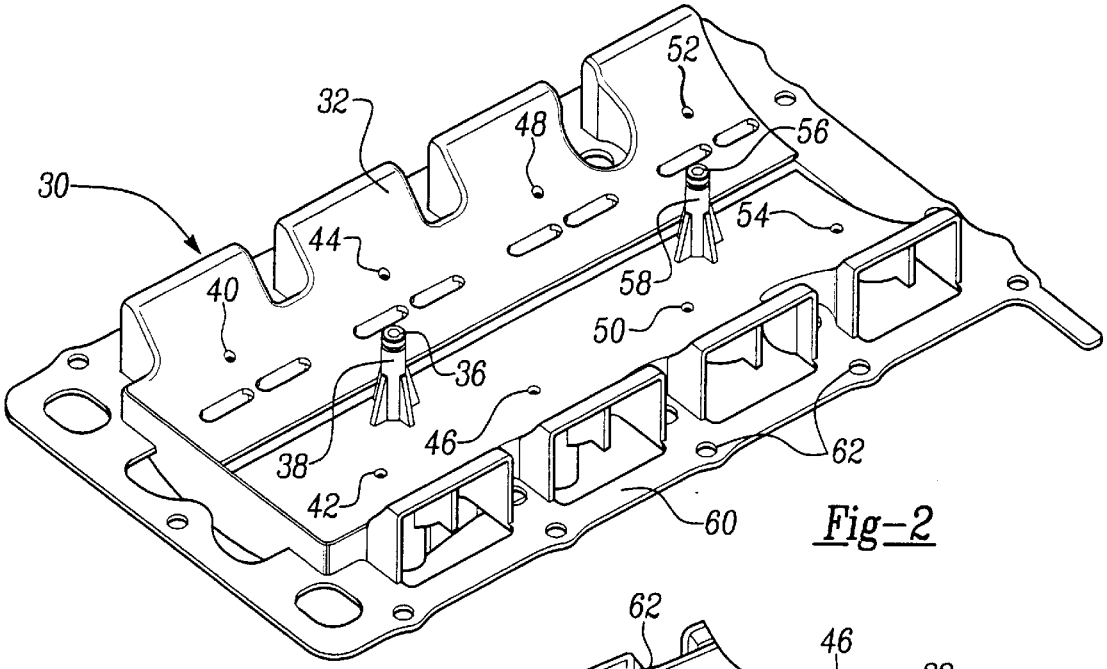
FIG. 2 is a perspective top view of a windage tray in accordance with the present invention.

Referring to the Figures, wherein like numerals indicate like or corresponding parts throughout the several views, FIG. 2 shows a perspective top view of a windage tray 30 in accordance with the present invention. Similar to the prior art, the windage tray 30 is adapted to be installed in an engine to deflect windage, or the disturbance of air, created by the rotation of an engine crankshaft, away from oil lying in an engine oil pan. Unlike the prior art, the windage tray 30 includes an arrangement or system of passages which provides an oil squirting feature to cool pistons within the engine.

Figure 4:
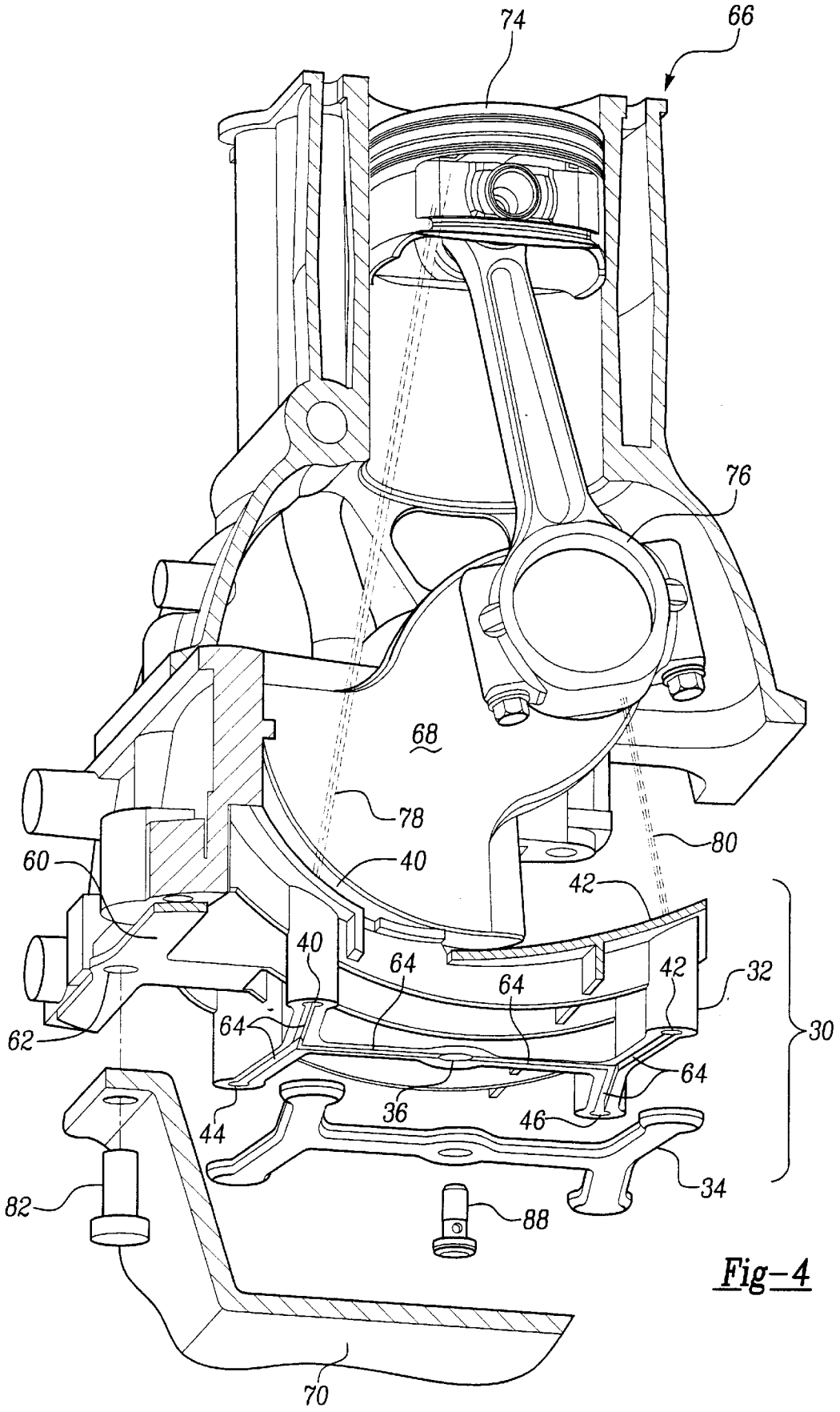
FIG. 4 is a fragmentary partially exploded perspective view of the windage tray in accordance with the present invention positioned within an engine between a crankshaft and an oil pan.

The windage tray 30 preferably consists of a two piece design, namely an upper body portion 32 and a lower cover portion 34 best seen in FIG. 4. However, in accordance with the scope of the present invention, one of ordinary skill in the art will recognize that the windage tray 30 may be manufactured in a one piece design.

Referring back to FIG. 2, the body 32 of the windage tray body 30 includes an oil inlet port 36 adapted to receive pressurized oil. The inlet port 36 extends through an upstanding oil inlet tube 38 and is in fluid communication with a first oil outlet port 40. The first outlet port 40 extends through the body 32 of the windage tray 30 and is adapted to squirt a first stream of the pressurized oil. In a preferred embodiment of the present invention, the inlet port 36 is also in fluid communication with a second oil outlet port 42 extending through the body 32 of the windage tray 30 and adapted to squirt a second stream of pressurized oil. In the above-mentioned preferred embodiment, two outlet ports are provided for each engine piston. The windage tray 30 shown in FIG. 2 includes eight similar outlet ports (40, 42, 44, 46, 48, 50, 52, and 54) and, therefore, is intended to be installed in a four cylinder engine. The windage tray 30 includes a third oil outlet port 44 and a forth oil outlet port 46 both in fluid communication with the inlet port 36. The four remaining oil outlet ports 48, 50, 52, and 54 are in fluid communication with a second oil inlet port 56 extending through a second upstanding oil inlet tube 58.

As shown in FIG. 2, the body 32 of the windage tray 30 is integrated with an engine oil pan gasket 60. The engine oil pan gasket 60 includes a plurality of apertures 62 adapted to receive fasteners for attaching the windage tray 30 and the oil pan gasket 60 to an engine. Preferably, the body 32 of the windage tray 30 is injection molded from an elastomer material, such as nylon.

Figure 3:
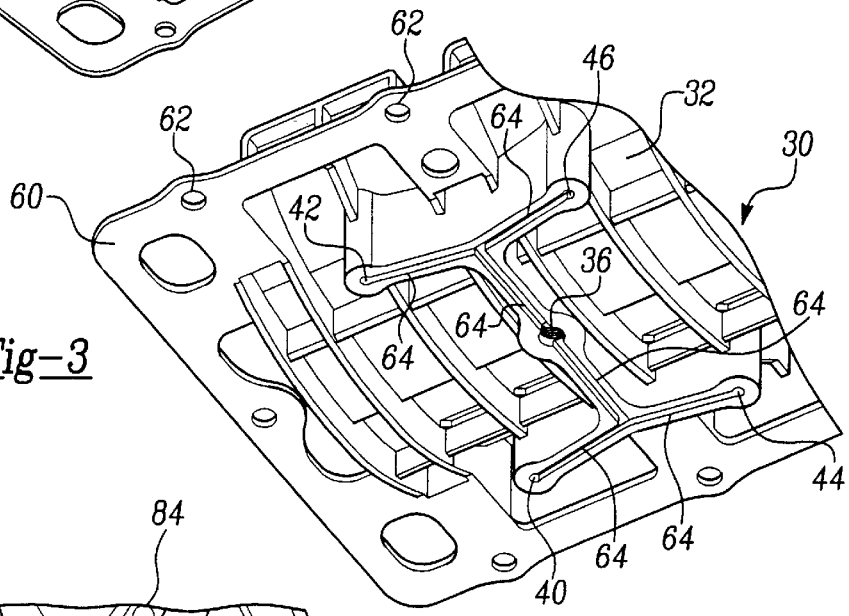
FIG. 3 is a fragmentary perspective bottom view of the windage tray in accordance with the present invention.

FIG. 3 is a fragmentary perspective bottom view of the body 32 of the windage tray 30 with the cover 34 removed to expose a plurality of lateral channels 64. The lateral channels 64 are formed in the body 32 of the windage tray 30 extending between the outtake of the oil inlet port 36 and the intake of the four adjacent oil outlet ports 40, 42, 44, and 46.

FIG. 4 is a fragmentary partially exploded perspective view of the body 32 and the cover 34 of the windage tray 30 positioned within an engine 66 between a crankshaft 68 and an oil pan 70. The cover 34 of the windage tray 30 is adapted to cover the lateral channels 64 to form fluid carrying passages between the inlet port 36 and the four adjacent outlet ports 40, 42, 44, and 46. Preferably, the cover 34 is injection molded from an elastomer material, such as nylon, and sonically welded or chemically bonded to the body 32 prior to installation of the windage tray 30 in the engine 66. One of ordinary skill in the art will recognize that the two piece windage tray design simplifies the manufacture of the lateral channels 64 during the production of the windage tray 30 by allowing the lateral channels 64 to be molded in the body 32.

The internal combustion engine 66 includes the crankshaft 68, a piston 74 movable through a cycle, a piston rod 76 connecting the piston 74 and the crankshaft 68, and the oil pan 70 spaced from the crankshaft 68. The internal combustion engine 66 operates in a conventional manner with one cycle of the piston 74 stroking the crankshaft 68 through one revolution. The first outlet port 40 is positioned to direct the first stream of pressurized oil 78 upon the underside of the piston 74 unobstructed by the piston rod 76 during a first portion of the piston cycle as shown in FIG. 4. During the first portion of the piston cycle, the second stream of pressurized oil 80 is obstructed by the piston rod 76 and does not reach the underside of the piston 74 as further shown in FIG. 4.

Accordingly, the second outlet port 42 is positioned to direct the second stream of pressurized oil 80 upon the underside of the piston 74 unobstructed by the piston rod 76 during the remaining portion of the piston cycle, not shown. During the remaining portion of the piston cycle, the first stream of pressurized oil 78 is obstructed by the piston rod 76 and does not reach the underside of the piston 74. Resultantly, at least one stream of pressurized oil 78 or 80 contacts or sprays the underside of the piston 74 at all times throughout the entire piston cycle to cool the piston.

A plurality of fasteners 82, such as bolts or other similar type fastening devices, are used to attach the oil pan 70 and the integrated windage tray 30 and oil pan gasket 60 to the engine 66.

Figure 5:
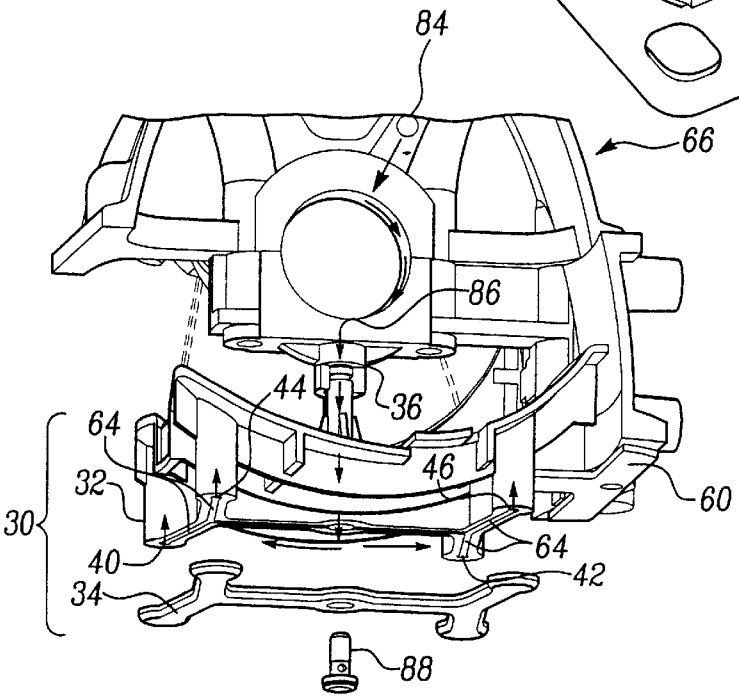
FIG. 5 is a partially exploded schematic view of the windage tray and the engine showing an oil flow path through the engine and windage tray.

FIG. 5 is a schematic view of the windage tray 30 and the engine 66 showing an oil flow path, indicated generally by solid arrows, through the engine and windage tray. Similar to other conventional internal combustion engines, a source of pressurized engine oil 84 is provided, when the engine 66 is running, to lubricate internal engine components. In accordance with the present invention, the oil source 84 is tapped and pressurized oil is supplied to the oil inlet port 36. The pressurized oil is routed from the oil inlet port 36 through the fluid carrying passages, formed by the lateral channels 64 and the cover 34 of the windage tray 30, to the adjacent oil outlet ports 40, 42, 44, and 46. The pressurized oil is then squirted from the outlet ports 40, 42, 44, and 46 towards the respective piston. Preferably, the pressurized oil is tapped and supplied from a crankshaft bearing lubrication means 86.

A check valve 88 is installed in the windage tray 30 to prevent the flow of oil through the fluid carrying passages when the engine 66 is not running and the oil source 84 is depressurized. In this manner, engine oil is held in the windage tray 30 and is available to immediately squirt and cool the pistons when the engine 66 is started.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims the invention may be practiced otherwise than as specifically described.

What is claimed is:

1. An internal combustion engine for a vehicle, said engine comprising:

a crankshaft;

a piston movable through a cycle;

a piston rod connecting said piston and said crankshaft;

an oil pan spaced from said crankshaft;

an oil source providing pressurized oil;

a windage tray positioned between said crankshaft and said oil pan; and a passage formed in said windage tray having an inlet port receiving said pressurized oil and a first outlet port directing a first stream of said pressurized oil at said piston.

2. An engine as set forth in claim 1 wherein said passage includes a second outlet port directing a second stream of pressurized oil at said piston.

3. An engine as set forth in claim 2 wherein said first outlet port is positioned to direct said first stream of pressurized oil upon said piston unobstructed by said piston rod during a first portion of said piston cycle and said second outlet port is positioned to direct said second stream of pressurized oil upon said piston unobstructed by said piston rod during the remaining portion of said piston cycle.

4. An engine as set forth in claim 1 wherein said windage tray includes a check valve preventing the flow of oil through said passage when oil from said oil source is depressurized.

5. An engine as set forth in claim 1 wherein said windage tray consists of a body portion having a channel formed therein and a cover portion for covering said channel to form said passage.

6. An engine as set forth in claim 5 wherein said cover portion is sonically welded to said body portion.

7. An engine as set forth in claim 5 wherein said body portion and said cover portion are injection molded from an elastomeric material.

8. An engine as set forth in claim 7 wherein said elastomeric material comprises a nylon.

9. An engine as set forth in claim 1 wherein said windage tray is integrated with an oil pan gasket having apertures adapted to receive fasteners for mounting said windage tray and said oil pan gasket to said engine.

10. For an internal combustion engine having a cylinder bore with a piston movable therein, an arrangement for squirting oil onto the underside of the piston for cooling, comprising:

a windage tray member supported in spaced relationship from the piston;

a source of pressurized oil;

said windage tray member having oil carrying passages formed therein and being fluidly connected to said source of pressurized oil;

an outlet aperture in said windage tray member oriented so as to direct a stream of oil at the underside of the piston for cooling the piston.

11. The piston cooling arrangement set forth in claim 10 in which said source of pressurized oil includes a crankshaft bearing lubrication means.

* * * * *